US005718004A

United States Patent [19]

Broersma et al.

[11] Patent Number: 5,718,004

[45] Date of Patent: Feb. 17, 1998

[54] EQUESTRIAN HELMET

[75] Inventors: Lester Broersma, Jamul; Mark Lecklider, Vista, both of Calif.

[73] Assignee: Troxel Cycling & Fitness LLC, San Diego, Calif.

[21] Appl. No.: 669,160

[22] Filed: Jun. 24, 1996

[51] Int. Cl.[6] ..... A42B 3/00

[52] U.S. Cl. ..... 2/425; 2/171.3

[58] Field of Search ..... 2/410, 411, 414, 2/421, 424, 425, 171.3, 173.5, 184.5, 204, 209.12, 209.3, 209.5, 209.7, 195.1, DIG. 1

[56] References Cited

U.S. PATENT DOCUMENTS

| | | | |
|---|---|---|---|
| 350,651 | 10/1886 | Basch | 2/209.5 |
| 432,728 | 7/1890 | Eliel | 2/171.3 |
| 735,790 | 8/1903 | Meerza | 2/171.3 |
| 934,508 | 9/1909 | Deely | 2/209.7 |
| 1,988,101 | 1/1935 | Wittcoff | 2/209.3 |
| 2,112,383 | 3/1938 | Sloan et al. | 2/209.5 |
| 3,790,962 | 2/1974 | Plastino | 2/411 |
| 4,345,336 | 8/1982 | Plastino | 2/187 |

FOREIGN PATENT DOCUMENTS

| | | | |
|---|---|---|---|
| 865015 | 5/1941 | France | 2/411 |

*Primary Examiner*—Michael A. Neas
*Attorney, Agent, or Firm*—Walter W. Duft

[57] ABSTRACT

An equestrian show helmet includes an impact resistant outer helmet shell formed to cover a wearer's head. The helmet shell has an upper dome-shaped portion and a lower rim extending from a forward portion of the dome, thence rearwardly to a pair of lateral side portions of the dome, and thence further rearwardly and downwardly to a rear portion of the dome wherein the rim is at its lowest point. A brim extends forwardly from the lower rim at the forward portion of the dome. A protective inner helmet liner is mounted within the dome portion of the helmet shell. The helmet liner has an upper dome-shaped portion that nests within the helmet shell, and a lower rim located substantially proximal to and extending substantially parallel with the helmet shell lower rim. A first vent aperture is formed in the helmet shell at a central top portion of the helmet shell dome. A second vent aperture is formed in the helmet liner at a central top portion thereof which is adjacent to the first vent aperture. A venting device is mounted to cover the first vent aperture on the helmet shell and has a raised button-shaped appearance. The helmet shell dome, the brim and the venting device are covered with velvet or a velvet-like decorative material, and a decorative satin-like covering is mounted to the inside of the helmet liner. A chin strap harness is mounted on the helmet adjacent the rim portions of the helmet shell and helmet liner.

20 Claims, 5 Drawing Sheets

EQUESTRIAN HELMET

BACKGROUND OF THE INVENTION

The present invention is directed generally to equestrian helmets. More particularly, the present invention concerns a novel helmet which may be used as an equine show hat or cap for riding and jumping competitions, equestrian shows and other English saddle riding events.

English saddle riders performing in competitions and show events typically wear an equestrian show hat or cap that conforms to very stringent aesthetic requirements. Many years of tradition dictate that such hats be covered in black velvet and include a forward brim, a decorative top button and a rear ribbon bow of unique appearance. The traditional show hat, as its name implies, is designed for appearance, not utility. It is not intended, for example, to provide substantial impact protection for the wearer. Yet horse riding accidents have resulted in serious head injuries to those who have suffered falls and other mishaps.

Just as head protection has reduced the likelihood and/or the extent of injuries in other sports, such as bicycle and motorcycle riding, it would be desirable to find a way to provide a satisfactory protective helmet for use in equestrian show riding. The need for such protection becomes even more compelling when it is considered that an increasing number of children are participating in English saddle riding events as the sport continues to gain popularity.

Helmets made for bicycles and the like are unsuited for equestrian show riding because they simply do not have the aesthetic appearance of a show hat. Moreover, existing bicycle helmets are functionally designed not only to protect the wearer's head, but to provide such protection in a comfortable manner by incorporating appropriate venting to direct cooling air through the protective outer shell and inner liner to the helmet interior. Such measures, however, are not readily adaptable to equestrian show hats. For example, bicycle helmets typically employ elongated holes formed in the front and sides of the helmet shell and liner to direct air to the helmet interior. Such vents are not practical for show hats because the vents would be considered unsightly. Without such vents, however, wearers of equestrian show helmets would likely reject them as being unduly hot and uncomfortable.

Accordingly, a need exists in the equestrian apparel art for a protective helmet that is fully functional in terms of crash protectability and wearer comfort yet also meets the stringent aesthetic requirements demanded by serious equestrian show riding enthusiasts. What is required in particular is a system for venting the helmet to cool the wearer's head without using the venting techniques previously employed in bicycle and other helmets.

SUMMARY OF THE INVENTION

In accordance with the foregoing objectives, an equestrian show helmet of novel design is provided. The equestrian show helmet includes an impact resistant outer helmet shell formed to cover a wearer's head. The helmet shell has an upper dome-shaped portion and a lower rim extending from a forward portion of the dome, thence further rearwardly to a pair of lateral side portions of the dome, and thence rearwardly and downwardly to a rear portion of the dome wherein the rim is at its lowest point. A brim extends forwardly from the lower rim at the forward portion of the dome. A protective inner helmet liner is mounted within the dome portion of the helmet shell. The helmet liner has an upper dome-shaped portion that nests within the helmet shell, and a lower rim located substantially proximal to and extending substantially parallel with the helmet shell lower rim. A first vent aperture is formed in the helmet shell at a central top portion of the helmet shell dome. A second vent aperture is formed in the helmet liner at a central top portion thereof which is adjacent to the first vent aperture. A venting device is mounted to cover the first vent aperture on the helmet shell and has a raised button-shaped appearance. The helmet shell dome, the brim and the venting device are covered with velvet or a velvet-like decorative material, and a decorative satin-like covering is mounted to the inside of the helmet liner. A chin strap harness is mounted on the helmet adjacent the rim portions of the helmet shell and helmet liner.

Advantageously, the venting device provide an aesthetically acceptable method for venting an equestrian show helmet in a manner that will improve the helmet's comfort and wearability. Additionally, the venting device may be constructed to assist in securing the helmet liner to the helmet shell, thereby improving helmet durability.

BRIEF DESCRIPTION OF THE DRAWINGS

The objects, advantages and features of the present invention will be more clearly understood by reference to the following detailed disclosure and the accompanying drawing in which.

DETAILED DESCRIPTION OF THE PREFERRED EMBODIMENTS

Figure 1:
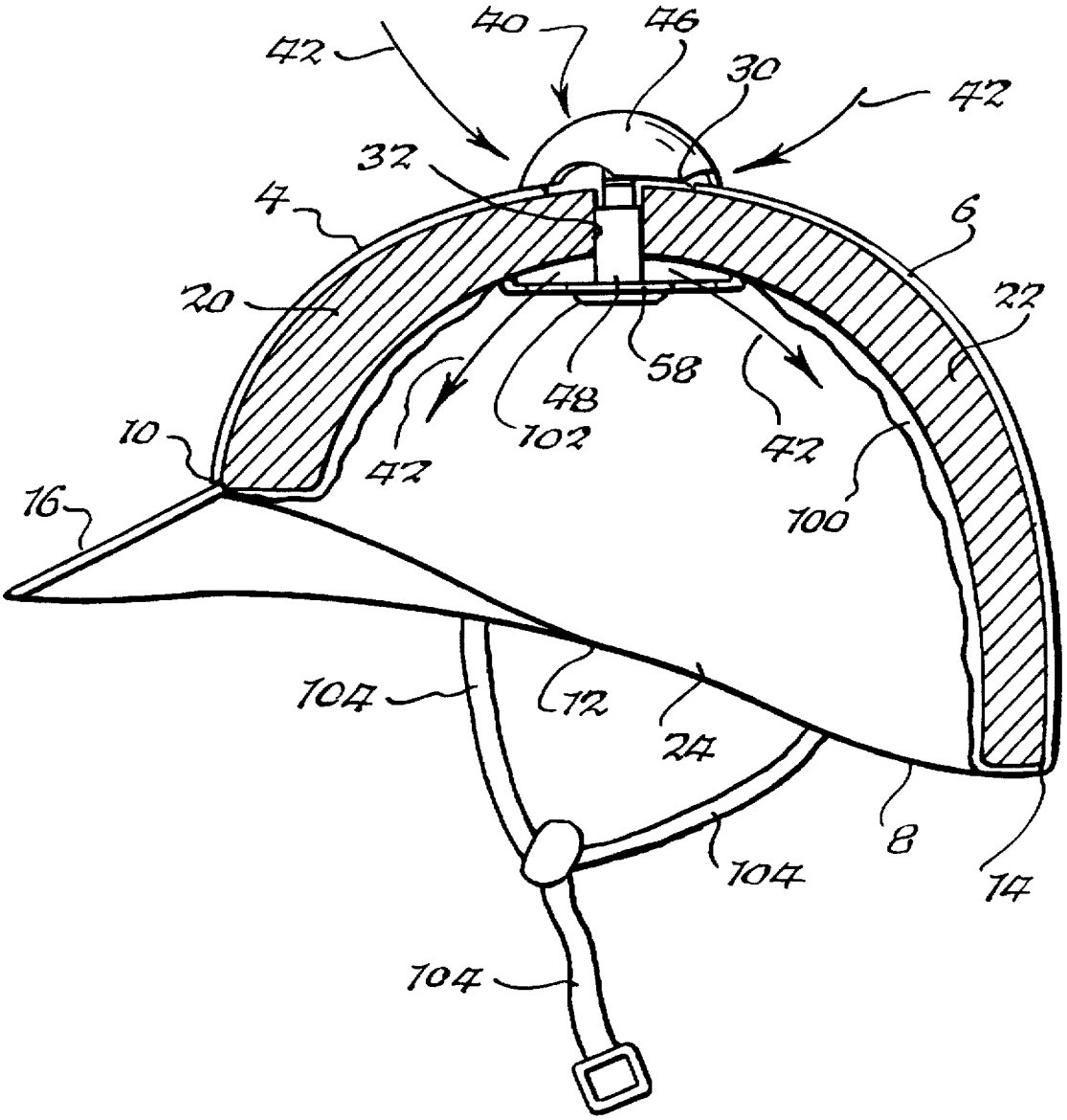
FIG. 1 is a side elevational view with a section thereof broken away for clarity showing an equestrian helmet constructed in accordance with preferred embodiments of the present invention.
Figure 10:
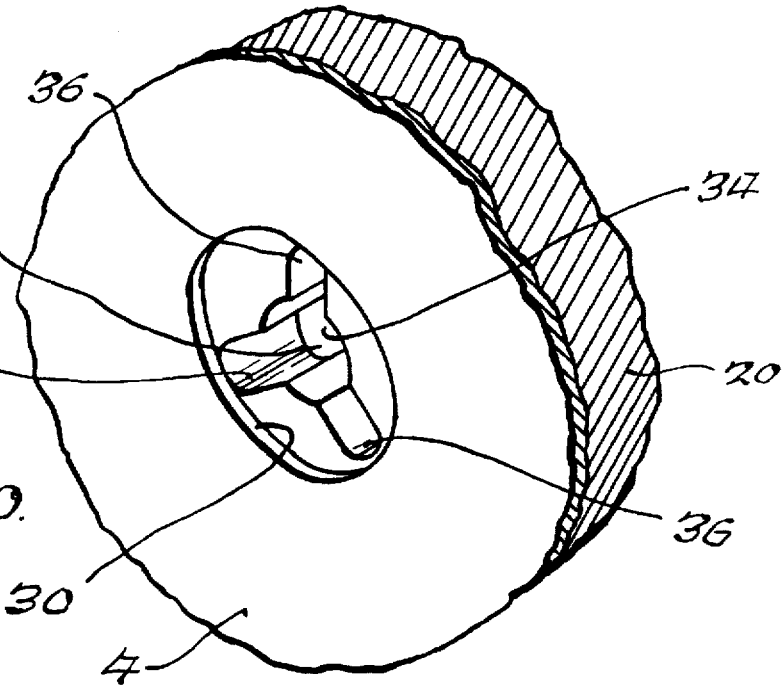
FIG. 10 is a partial perspective view taken from the outside of a helmet showing vent apertures formed in the helmet shell and the helmet liner.

Referring now to FIG. 1, an equestrian show helmet 2 includes an impact resistant outer helmet shell 4 formed to cover a wearer's head. The helmet shell 4 has an upper dome portion 6 and a lower rim 8 extending from a forward portion 10 of the dome 4, thence rearwardly to a pair of lateral side portions 12 of the dome 4, and thence further rearwardly and downwardly to a rear portion 14 of the dome 4 wherein the rim 8 is at its lowest point. A brim 16 extends forwardly from the lower rim 8 at the forward portion 10 of the dome 4. The helmet shell may be formed using conventional molding techniques from materials such as acrylibutylstyrene (ABS) or the like. A protective inner helmet liner 20 is mounted within the dome portion 4 of said helmet shell 6. The helmet liner 20 has an upper dome portion 22 that nests within the helmet shell 4, and a lower rim 24 located substantially proximal to and extending substantially parallel with the helmet shell lower rim 24. The helmet liner may be formed using conventional molding techniques from materials such as expanded polystyrene (EPS) or the like. A first vent aperture 30 is formed in the helmet shell 4 at a central top portion of the helmet shell dome 4. A second vent aperture 32 is formed in the helmet liner 20 at a central top portion thereof which is adjacent to the first vent aperture 30. For reasons which will become apparent hereinafter, the second vent aperture 32 includes a central cylindrical bore component 34 and a plurality of side vent components 36, as shown in FIG. 10.

A venting device 40 is mounted to cover at least the first vent aperture 30 on the helmet shell 4 and has a raised button-shaped appearance that is advantageous for satisfying the aesthetic requirements of equestrian show hats. The venting device 40 provides an air passage through the helmet 2 in combination with the first and second apertures 30 and 32 to transmit a flow of air 42 from the outside of the helmet 2 to the inside thereof. The venting device may be constructed in a variety of ways but is preferably formed from two components that are sandwiched together in order to help secure the helmet liner 20 to the helmet shell 4. In this two-component configuration, the venting device may include an outer finial 46 and an inner escutcheon 48 that are secured together within the first and second apertures 30 and 32.

Figure 2:
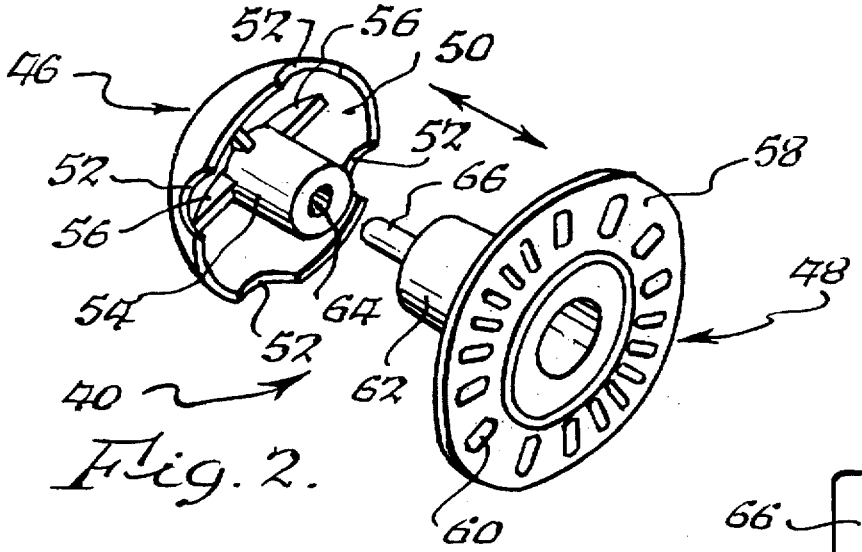
FIG. 2 is a perspective view showing an equestrian helmet venting device constructed in accordance with one aspect of the present invention.

Referring now to FIG. 2, the finial 46 has a generally dome-shaped upper portion 50 that includes one or more arched vent openings 52 to permit the passage of air therethrough. The finial also includes a central mounting stem 54 supported by a plurality of support flanges 56 as may be necessary for structural stability. The escutcheon 48 has a generally flat lower base portion 58 that includes a plurality of vent openings 60 to permit the passage of air therethrough. The escutcheon also includes a central mounting stem 62 extending from the base portion 58. As shown in FIG. 1, the air passage for the air flow 42 is provided by the finial and escutcheon vent openings 52 and 60 acting in combination with the first and second apertures 30 and 32 formed in the helmet shell 4 and the helmet liner 20, respectively.

Figure 3:
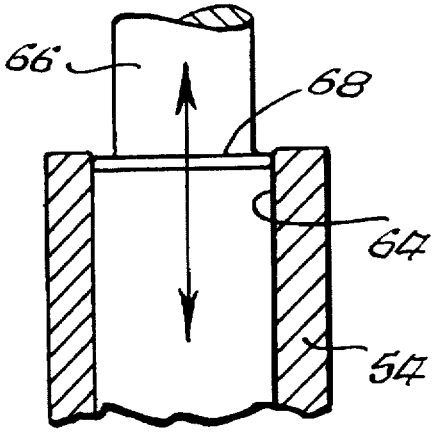
FIG. 3 is a detailed cross-sectional view showing an escutcheon and a finial portion of the helmet venting device shown in FIG. 2.

The finial 46 may be secured to the escutcheon 48 in a variety of ways. FIGS. 2 and 3 illustrate an embodiment in which these components are joined by gluing. The stem 54 of the finial 46 is formed with a hollow bore 64, while the escutcheon stem 62 is formed with a secondary stem 66 that nests within the hollow bore 64 of the finial stem 54. As shown in FIG. 3, a band of glue 68, which maybe formed from any suitable adhesive, such as a cyanoacrylate compound, is applied to the secondary escutcheon stem 66. The stem 66 is then inserted into the bore 64 of the finial stem 54 in order to adhesively secure the finial 46 and escutcheon 48 together.

Figure 4:
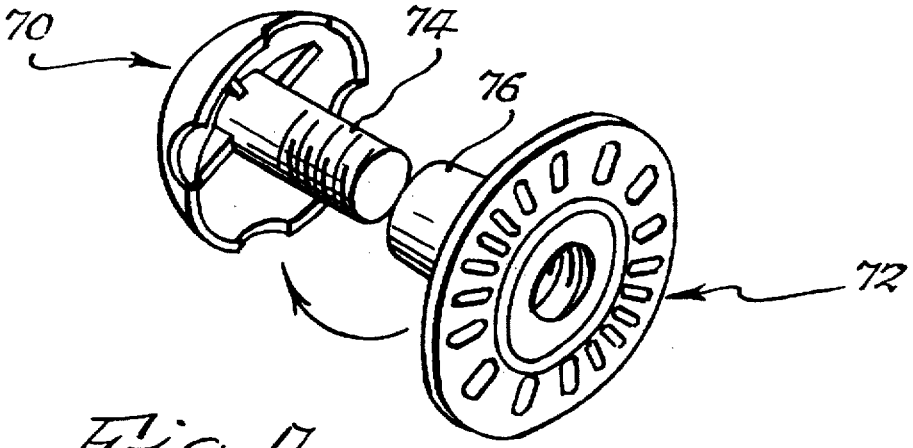
FIG. 4 is a perspective view showing an equestrian helmet venting device constructed in accordance with another aspect of the present invention.

FIG. 4 illustrates an alternative embodiment wherein a finial 70 and an escutcheon 72 are mechanically joined. In that embodiment, the finial 70 and the escutcheon 72 are identical to the finial 46 and the escutcheon 48 of FIG. 2 except the mounting stems are different. The finial 70 includes an externally threaded stem 74 that is configured to engage an internally threaded stem 76 formed on the escutcheon 72.

Figure 5:
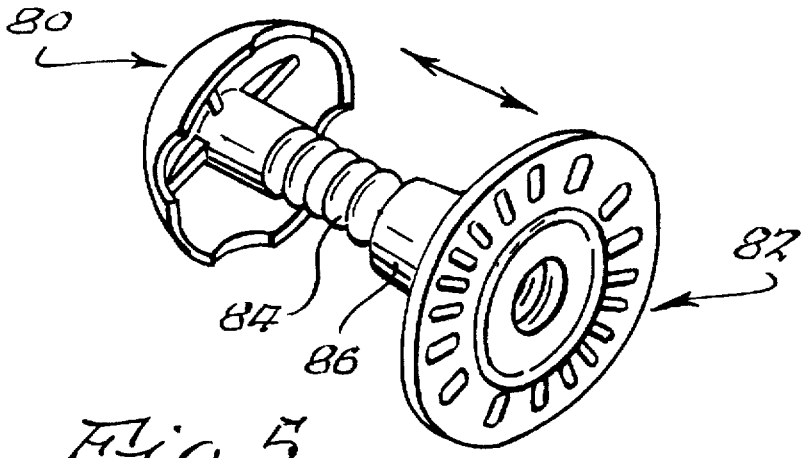
FIG. 5 is a perspective view showing an equestrian helmet venting device constructed in accordance with still another aspect of the present invention.

FIG. 5 illustrates another alternative embodiment wherein a finial 80 and an escutcheon 82 are mechanically joined in another way. In that embodiment, the finial 80 and the escutcheon 82 are identical to the finial 46 and the escutcheon 48 of FIG. 2 except the mounting stems are configured to provide a so-called "Christmas tree" mounting arrangement. The finial 80 includes a ribbed stem 84 that is configured to engage a stem 86 formed on the escutcheon 82. The stem 86 is formed with a central bore having a series of detents that are configured, along with the ribs of the stem 84, to provide a "jam" fit that allows the stem 84 to be inserted into the bore of the stem 86 but prevents its removal therefrom.

Figure 6:
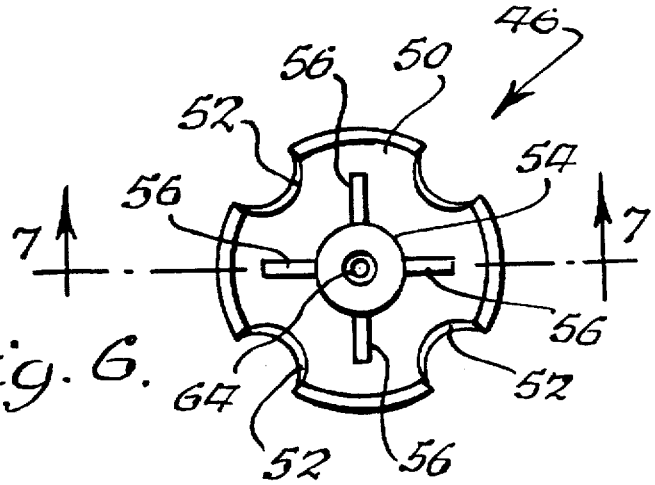
FIG. 6 is a detailed bottom view of the finial shown in FIG. 3.
Figure 7:
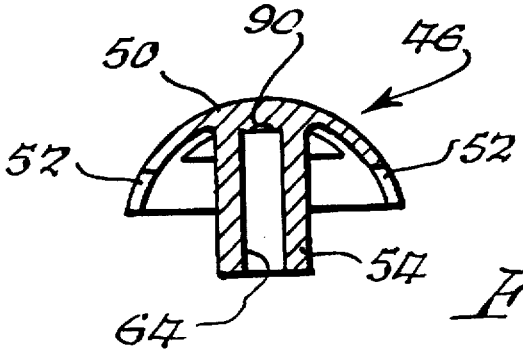
FIG. 7 is a detailed cross-sectional view of the finial shown in FIG. 3 taken along line 7—7 in FIG. 6.
Figure 8:
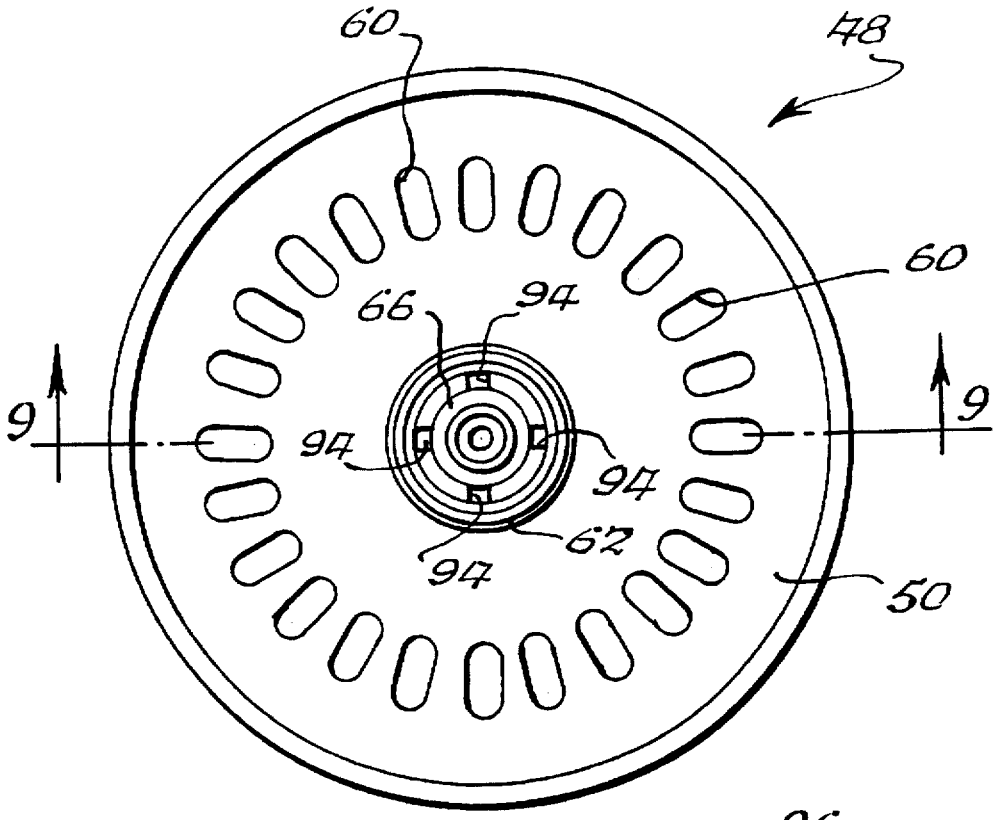
FIG. 8 is a detailed plan view of the escutcheon shown in FIG. 3.
Figure 9:
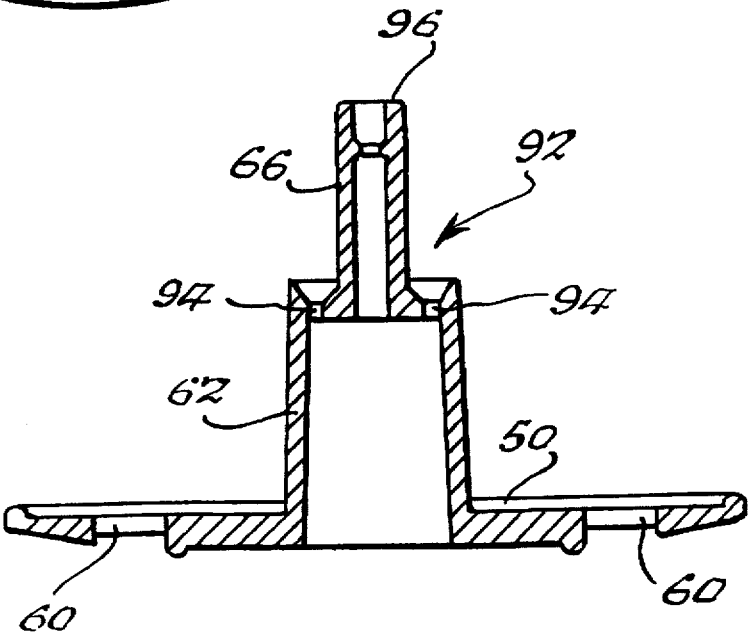
FIG. 9 is a detailed cross-sectional view of the escutcheon shown in FIG. 3 taken along line 9—9 in FIG. 8.

Referring now to FIGS. 6–9, the finial 46 and the escutcheon 48 are illustrated in detail to show that these components can be mounted to one another such that the finial 46 collapses onto the escutcheon 48 under impact loads to reduce the possibility of head trauma caused by the escutcheon 48 being driven against a wearer's head. As shown in FIGS. 6 and 7, the finial 46 includes a load bearing section 90 formed as part of the domed-shaped upper portion 50 at the back of the bore 64 formed in the mounting stem 54. The load bearing section 90 is configured to resist an impact imparted by the secondary stem 66 of the escutcheon 48 should an impact load be applied to the venting device 40. As shown in FIGS. 8 and 9, the escutcheon 48 includes an annular thin-walled section 92 extending between the mounting stem 62 and the secondary stem 66 and joining those stem members together. The thin-walled section 92 is formed with apertures 94 in order to weaken the section so that it will yield when an impact load of sufficient magnitude is imparted as a result of the end portion 96 of the secondary stem 66 engaging the load bearing section 90 when the finial 46 and the escutcheon 48 are forced together.

Figure 11:
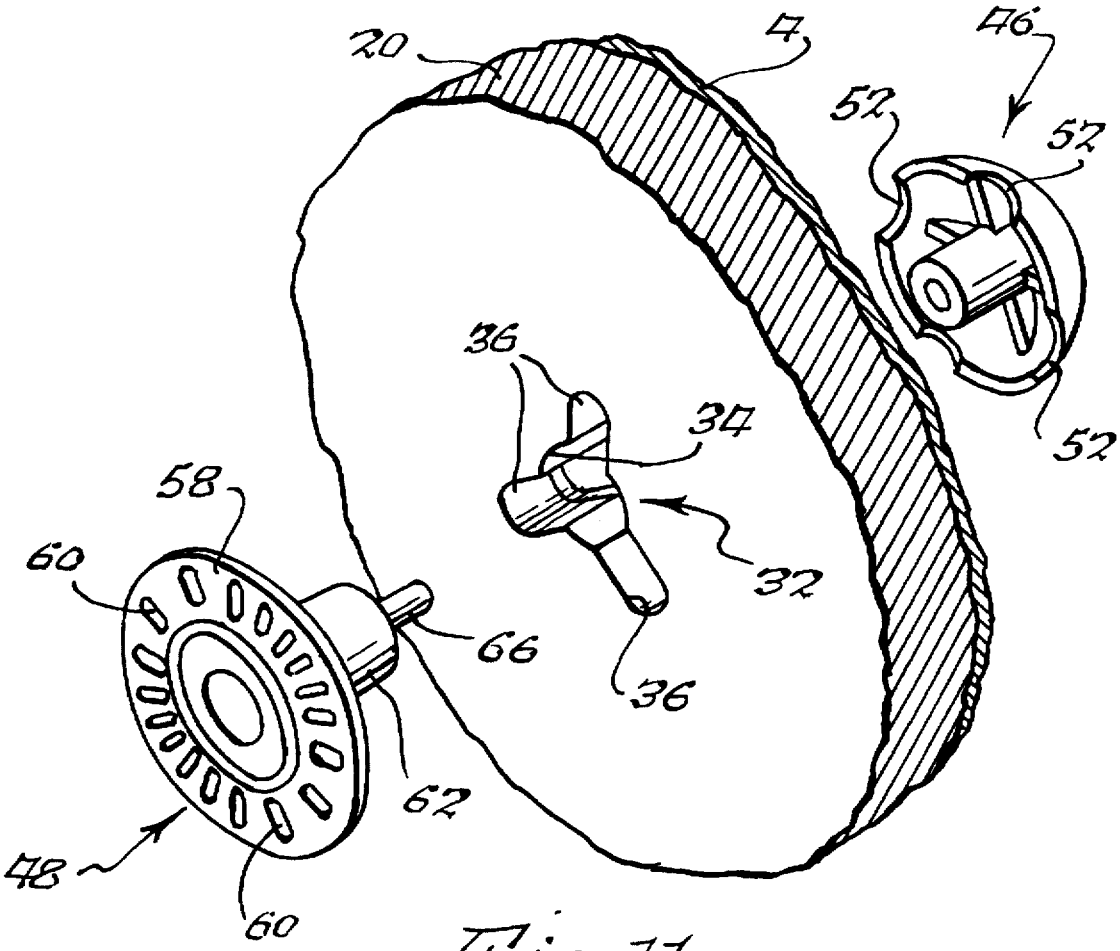
FIG. 11 is a partial perspective view taken from the inside of a helmet showing the vent apertures illustrated in FIG. 10 and the manner in which the escutcheon and finial extend therethrough.

Referring now to FIGS. 10 and 11, the assembly of the equestrian helmet 2 can be simplified if the second aperture 32 of the inner shell 20 includes a central diameter 34 sized to engagingly receive the stem portion 62 of the escutcheon 48. This helps to secure the escutcheon 48 in position during assembly while the finial 46 is inserted through the helmet shell aperture 30 and glued (or otherwise attached) on the secondary escutcheon stem 66. The second aperture 32 further includes lateral openings 36 extending from the central diameter 34. The lateral openings communicate with the finial and escutcheon vent openings 52 and 60 to provide a portion of the air passage that facilitates the air flow 42. Advantageously, the finial 46 and the escutcheon 48, when joined together, sandwich the helmet liner 20 and the helmet shell 4 therebetween so as to help secure the liner and shell components together as an integral unit.

To complete the helmet 2, the outer shell dome 6, the brim 16 and the finial 46 of the venting device 40 are covered with velvet or a velvet-like decorative material. As shown in FIG. 1, a satin-like decorative covering 100 is mounted in the helmet liner and secured to the flat portion 58 of the escutcheon 48 and to the rim portion 24 of the helmet liner 20. For added attractiveness, a medallion 102 bearing a trade logo or stylized design could be mounted on the bottom of the escutcheon 48, i.e., on the flat portion 58 thereof. Finally, a chin strap harness 104 is mounted on the helmet adjacent to the rim portions 8 and 24 of the helmet shell 4 and the helmet liner 20, respectively.

Accordingly, an aesthetically pleasing equestrian helmet to be worn by riders for equestrian shows has been disclosed. The helmet can be manufactured using a series of simple steps which may be performed in any order deemed appropriate. Reiterating the steps of the preferred manufacturing method disclosed above, an outer helmet shell is formed in the shape of a traditional equestrian show hat, including an upper dome portion to cover a wearer's head, a front visor and an aperture formed in a central uppermost portion of the dome. An inner protective helmet liner is formed to fit snugly within the dome portion of the helmet shell. The inner liner includes an aperture formed in a central uppermost portion of the dome. The helmet liner is mounted to an inside portion of the helmet shell with the respective apertures therein aligned with one another. A velvet or velvet-like covering is mounted over outside portions of the helmet shell. A decorative satin-like liner is secured to an inside portion of the helmet liner. A decorative air vent device is mounted or formed to extend through the helmet shell aperture and the helmet liner aperture. The decorative air vent preferably includes, but does not necessarily require, an inner escutcheon piece that attaches to a central uppermost portion of the decorative liner, extends at least partially in the helmet liner aperture and, optionally, may have a decorative logo formed on an inner portion thereof. The decorative air vent further preferably includes, but does not necessarily require, an outer finial piece having a dome-shaped exterior covered with velvet or a velvet-like material and an inner portion extending at least partially in the outer shell aperture and engaging the escutcheon piece, the finial piece thereby having an external appearance resembling a button on a traditional equestrian show hat.

While various embodiments have been disclosed, it should be apparent that many variations and alternative embodiments would be apparent to those skilled in the art in view of the teachings herein. For example, the term "venting device" is used in its broadest sense to include any structure, whether separately fabricated and mounted on the helmet shell, or formed as part of the helmet shell itself, that provides a rounded surface incongruence which can be covered with material to provide a button-like appearance, and which also facilitates the passage of air to the helmet interior, either alone or in combination with other structure. It is understood, therefore, that the invention is not to be in any way limited except in accordance with the spirit of the appended claims and their equivalents.

We claim:

1. An equestrian show helmet, comprising:

an impact resistant outer helmet shell formed to cover a portion of a wearer's head, said helmet shell having an upper dome portion and a lower rim extending from a forward portion of said dome, thence rearwardly to a pair of lateral side portions of said dome, and thence rearwardly and downwardly to a rearward portion of said dome wherein said rim is at its lowest point;

a brim extending forwardly from said lower rim at said forward portion of said dome;

a protective inner helmet liner mounted within said dome portion of said outer shell, said helmet liner having an upper dome portion sized to engage said helmet shell dome portion and a lower rim located substantially proximal to and extending substantially parallel with said helmet shell lower rim, such that said upper dome portion and said lower rim of said helmet liner are substantially coextensive with said upper dome portion and said lower rim of said helmet shell;

a first vent aperture formed in said helmet shell at a central uppermost top portion of said helmet shell dome;

a second vent aperture formed in said helmet liner at a central uppermost top portion of said helmet liner which is adjacent to said first vent aperture;

a venting device mounted to cover at least said first aperture on said helmet shell and at least a portion thereof having a raised button-shaped appearance, said venting device being secured to said helmet shell and said helmet liner and extending through said first and second apertures in order to provide a passage for air to pass through said helmet in combination with said first and second apertures;

said helmet shell upper dome portion, said brim and said venting device being covered with velvet or velvet-like decorative material;

a decorative covering mounted within said helmet liner extending from said lower rim of said helmet liner to a location between said venting device and said helmet liner; and a chin strap harness mounted on said helmet adjacent the rim portions of said helmet shell and helmet liner.

2. The equestrian helmet of claim 1 wherein said venting device includes an outer finial and an inner escutcheon that are secured together within said first and second apertures.

3. The equestrian helmet of claim 2 wherein said finial has a generally dome-shaped upper portion that includes one or more vent openings to permit the passage of air therethrough.

4. The equestrian helmet of claim 3 wherein said escutcheon has a generally flat lower portion that includes one or more vent openings to permit the passage of air therethrough.

5. The equestrian helmet of claim 4 wherein said air passage is provided by said finial and escutcheon vent openings in combination with said first and second apertures.

6. The equestrian helmet of claim 5 wherein said finial and escutcheon include stem portions that are secured together within said first and second apertures.

7. The equestrian helmet of claim 6 wherein said finial and escutcheon stem portions are glued together.

8. The equestrian helmet of claim 6 wherein said finial and escutcheon stem portions are held together by mechanical engagement.

9. The equestrian helmet of claim 6 wherein said second aperture in said helmet shell includes a central diameter sized to engagingly receive the stem portion of said escutcheon to secure said escutcheon in position during assembly, said second aperture further including lateral openings extending from said central diameter and aligned with said escutcheon vent openings to provide a portion of said air passage.

10. The equestrian helmet of claim 9 wherein said finial and escutcheon stem portions are nested and are collapsibly mounted to one another such that said finial collapses onto said escutcheon under impact loads to reduce the possibility of head trauma caused by the escutcheon being driven against a wearer's head.

11. In an equestrian helmet to be worn by riders at equestrian events, said equestrian helmet having an air vent system, comprising:

an aperture formed in said equestrian helmet at a central uppermost portion thereof, said aperture including inner and outer portions respectively extending through inner and outer sides of said helmet, said inner aperture portion having a central gripping area and a plurality of peripheral vent passages;

escutcheon means mounted on said inner side of said helmet and having a portion thereof extending into said aperture;

finial means mounted on said outer side of said helmet and having a portion thereof extending into said aperture and engaging said escutcheon;

means for securing said finial to said escutcheon; and air passage means extending between said finial and said escutcheon.

12. The equestrian helmet of claim 11 wherein said finial has a generally dome-shaped upper portion that includes one or more vent openings to permit the passage of air therethrough and a stem portion extending into said aperture.

13. The equestrian helmet of claim 12 wherein said escutcheon has a generally flat lower portion that includes one or more vent openings to permit the passage of air therethrough and a stem portion extending into said aperture.

14. The equestrian helmet of claim 13 wherein said air passage is provided by said finial and escutcheon vent openings in combination with said aperture.

15. The equestrian helmet of claim 14 whereto said finial and escutcheon stems are nested.

16. The equestrian helmet of claim 15 wherein said nested finial and escutcheon stems are secured together with glue.

17. The equestrian helmet of claim 15 wherein said nested finial and escutcheon stems are secured together mechanically.

18. The equestrian helmet of claim 15 wherein said finial and escutcheon stems are collapsibly mounted together.

19. The equestrian helmet of claim 18 wherein said finial includes a portion configured to yield under an impact imparted by said escutcheon stem and wherein said escutcheon includes a portion configured to yield under an impact imparted by said finial stem.

20. A method for manufacturing an aesthetically pleasing equestrian helmet to be worn by riders at equestrian events, comprising the following steps to be performed in any order deemed appropriate:

forming an outer helmet shell in the shape of a traditional equestrian show hat, including an upper dome to cover a wearer's head, a lower rim, a front visor and an aperture formed in the central uppermost portion of said dome;

forming an inner protective helmet liner that is sized to fit snugly within the dome portion of said helmet shell and extending substantially coextensively therewith from said dome portion to said lower rim, said helmet liner including an aperture formed in a central uppermost portion thereof;

mounting said helmet liner to an inside portion of said helmet shell with the respective apertures therein aligned with one another;

mounting a velvet or velvet-like covering over outside portions of said helmet shell;

mounting a decorative liner to an inside portion of said helmet liner;

providing a decorative air vent device extending through said helmet shell aperture and said helmet liner aperture, said decorative air vent including an inner escutcheon piece that attaches to a central uppermost portion of said decorative liner, extends at least partially in said helmet liner aperture and has a decorative logo formed on an inner portion thereof, said decorative air vent further including an outer finial piece having a dome-shaped exterior covered with velvet or a velvet-like material and an inner portion extending at least partially in said helmet shell aperture and engaging said escutcheon piece, said finial piece thereby having an external appearance resembling a button on a traditional equestrian show hat.

* * * * *